United States Patent [19]

Mouri et al.

[11] 4,226,254

[45] Oct. 7, 1980

[54] COIN SELECTING AND COUNTING MACHINE

[75] Inventors: Shingo Mouri; Nobuo Ueda, both of Tokyo, Japan

[73] Assignee: Laurel Bank Machine Co., Ltd., Tokyo, Japan

[21] Appl. No.: 4,213

[22] Filed: Jan. 17, 1979

[30] Foreign Application Priority Data

Jan. 25, 1978 [JP] Japan ..... 53/6973

[51] Int. Cl.[3] ..... G07D 9/04

[52] U.S. Cl. ..... 133/8 E

[58] Field of Search ..... 133/3 A, 3 F, 8 E, 8 R, 133/3 D

[56] References Cited

U.S. PATENT DOCUMENTS 3,771,538 11/1973 Reis ..... 133/8 R X

FOREIGN PATENT DOCUMENTS 2510230 9/1976 Fed. Rep. of Germany ..... 133/3 A 83691 7/1978 Japan .

*Primary Examiner*—Stanley H. Tollberg

*Attorney, Agent, or Firm*—Fleit & Jacobson

[57] ABSTRACT

A coin selecting and counting machine for selecting and counting a number of mixed coins in accordance with the kinds thereof on the basis of differences in their diameters. The coin selecting and counting machine includes a rotary disc which is made rotatable for discharging the mixed coins by the centrifugal force thereof and a selecting and counting track formed with selecting holes for receiving the discharged mixed coins to allow the same to fall into the corresponding holes, while being unidirectionally conveyed one by one. The track is composed of a guide rail section, a curved rail section and a counting rail section. The curved rail section extends between the other two rail sections for changing the moving direction of the mixed coins to force the same into contact with its curved inner wall. Thus, the coins, which might otherwise be imprecisely located widthwise of the track, can have their circumferences further forced into contact with the inner wall of the counting rail section while being selected and counted.

5 Claims, 2 Drawing Figures

COIN SELECTING AND COUNTING MACHINE

BACKGROUND OF THE INVENTION

1. Field of the Invention

The present invention relates to a coin selecting and counting machine for selecting and counting "mixed coins", namely a number of coins of different kinds in mixed conditions, in accordance with their kinds while they are being conveyed on a flat selecting and counting track, and more particularly to a coin selecting and counting machine which is equipped with a curved rail section which is provided to ensure the rolling contact of the circumferences of the mixed coins with the inner surface of the reference rail downstream of a guide rail section in order to realize the desired selecting and counting of coins.

2. Description of the Prior Art

Coin selecting and counting machines of the type which accomplish selecting operations taking advantage of the fact that the coins to be selected have different diameters. However, when it is intended to introduce the mixed coins from a rotary disc to a guide rail section and to guide the same into a selecting and counting rail, the coins thus introduced cannot be positioned uniformly because the guide rail section has a slightly larger width than the maximum diameter of the coins. This makes it necessary for the circumferences of the coins to be forced into contact with the inner wall of the reference rail. In order to meet this requirement, therefore, one of the conventional selecting and counting machine has its coin conveying belt inclined with respect to the reference rail so that the coins may move along the reference rail when the conveying belt is made to run. If, in this particular case, a thinner coin is moving between thicker coins, it fails to be held by the running belt and to move along the reference rail due to the difference in thickness among the coins being conveyed by the inclined belt. On the other hand, however, the coin selecting and counting machine thus described has an advantage that the coins cannot fail to be conveyed in contact with the reference rail once they move along the same rail.

SUMMARY OF THE INVENTION

It is therefore a primary object of the present invention to provide a coin selecting and counting machine which is free from the disadvantages of the prior art.

Another object of the present invention is to provide a coin selecting and counting machine of the above type, which is equipped with a curved rail section positioned downstream of a coin guide rail section so that a variety of mixed coins introduced from a rotary disc may be conveyed along a reference rail without fail.

A further object of the present invention is to provide a coin selecting and counting machine of the above type, in which a turning disc mechanism and a selecting and counting rail section can be overlapped on a plane in the longitudinal direction by the provision of the curved rail section so that the total length of the machine can be reduced.

According to a major feature of the present invention, there is provided a coin selecting and counting machine for selecting and counting a number of mixed coins in accordance with the kinds thereof on the basis of the differences in this diameters, including a rotary disc made rotatable for discharging the mixed coins by the centrifugal force thereof, and a selecting and counting track extending downstream of said rotary disc and formed at its bottome with selecting holes of a number and sizes corresponding to the kinds fo the mixed coins for receiving the discharged mixed coins to allow the same to fall into the corresponding selecting holes, while being conveyed, so that they may be selected and counted, wherein the improvement comprises: said selecting and counting track including a guide rail section extending downstream of said rotary disc for guiding the discharged mixed coins, a curved rail section extending downstream of said guide rail section for changing the moving direction of the mixed coins to force the same into contact with the curved inner wall thereof, and a counting rail section extending downstream of said curved rail section; conveying means for conveying the mixed coins from said guide rail section to said curved rail section; second conveying means for conveying the mixed coins from said curved rail section through said counting rail section, so that the mixed coins, which might otherwise be inconsistently located widthwise of said selecting and counting track, may have their circumferences forced into contact with the inner wall of said curved rail section and accordingly with the inner wall of said counting rail section; and counting means arranged in said counting rail section for counting each kind of the mixed coins.

BRIEF DESCRIPTION OF THE INVENTION

Other objects and advantages of the present invention will become apparent from the following description taken in conjunction with the accompanying drawings, in which:

FIG. 1 is a top plan view showing the overall construction of one embodiment of a coin selecting and counting machine according to the present invention; and FIG. 2 is an enlarged top plan view showing the curved rail section, which constitutes an essential portion of the coin selecting and counting machine of the present invention, in its coin guiding condition.

DESCRIPTION OF THE PREFERRED EMBODIMENT

Figure 1:
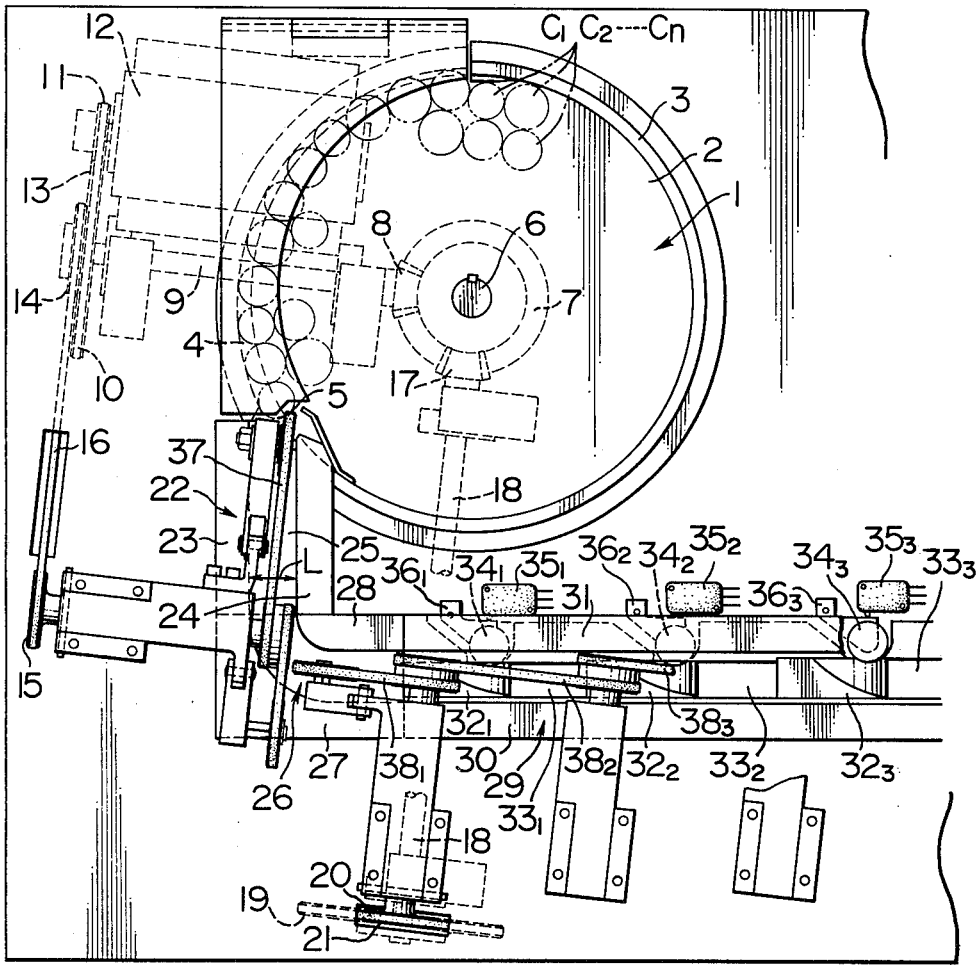

The present invention will now be described in connection with one embodiment thereof with reference to the accompanying drawings. A variety of mixed coins $C_1, C_2, ---, C_n$ a rotary disc 2 of a turning disc mechanism 1 are conveyed along a selecting ring 3 by the centrifugal force of the disc 2 to a coin aligning course 4, in which they are brought into a line so that they are further conveyed in series to an outlet 5.

A larger bevel gear 7 is fixed to the spindle 6 of the rotary disc 2 and is brought into meshing engagement with a smaller bevel gear 8. A larger drive pulley 10 is fixed to the other end of the spindle 9 of the smaller bevel gear 8, and a smaller drive pulley 11 is fixed to the shaft of a motor 12 so that the rotation of the motor 12 are transmitted through a belt 13 and the pulley 10 to the rotary disc 2. At the other side of a larger drive pulley 15, a smaller pulley 14 is fixed to the spindle 9 so that the larger pulley 15 is turned by means of a belt 16. On the other hand, a smaller gear 17 is made to mesh with the larger gear 7, which is turned by the motor 12, so as to turn a spindle 18 so that a larger pulley 19 fixed to the other end of the spindle 18 turns a pulley 21 by means of a belt 20.

A guide rail section 22 is constructed to have its coin inlet connected to the outlet 5 of the turning disc mechanism 1. The guide rail section 22 is composed of a left guide rail 23, a right guide rail 24 and a bottom plate 25. The spacing L between the left and right guide rails 23 and 24 is made slightly wider than the diameter of the largest of the mixed coins $C_1, C_2, ---, C_n$ so that the mixed coins of different diameters can be introduced one by one into the guide rail section 22.

The outlet end of the left guide rail 23 is merged into the inlet end of a curved rail 27 having a large radius of curvature of a curved rail section 26 so that the mixed coins $C_1, C_2, ---, C_n$ introduced one by one are conveyed along the curved rail 27, while having their circumferences in contact therewith, thus changing their course.

The curved rail section 26 thus constructed has its outlet end connected to the inlet end of a counting rail section 29 such that the inlet end of the curved rail 27 is merged into a reference rail 30 and that a selecting rail 31 arranged at the opposite side of the reference rail 30 is merged into a smaller curved rail 28. There are interposed between the reference rail 30 and the selecting rail 31 a series of counting slopes $32_1, 32_2, ---, 32_n$, immediately downstream of which are arranged a series of selecting holes $33_1, 33_2, ---, 33_n$ having different widthes. There are also provided for the selecting holes $33_1, 33_2, ---, 33_n$ a series of counting rollers $34_1, 34_2, ---, 34_n$ which are actuated by the mixed coins $C_1, C_2, ---, C_n$. These counting rollers $34_1, 34_2, ---, 34_n$ are mounted to a series of rockable counting arms $36_1, 36_2, ---, 36_n$ so that a series of corresponding counters $35_1, 35_2, ---, 35_n$ are operated by the rocking motions of the counting arms $36_1, 36_2, ---, 36_n$.

There is arranged above the guide rail section 22 a guide belt 37 which is made to run by the larger drive pulley 15 so that it may convey the mixed coins $C_1, C_2, ---, C_n$ introduced.

In the curved rail section 26 at the side of the counting rail section 29, the mixed coins $C_1, C_2, ---, C_n$ thus conveyed are transferred to a series of corresponding counting belts $38_1, 38_2, ---, 38_n$, which are made to run above the counting rail section 29, so that they actuate the corresponding counting rollers $34_1, 34_2, ---, 34_n$ at their respective proper positions until they fall into the corresponding selecting holes $33_1, 33_2, ---, 33_n$.

Figure 2:
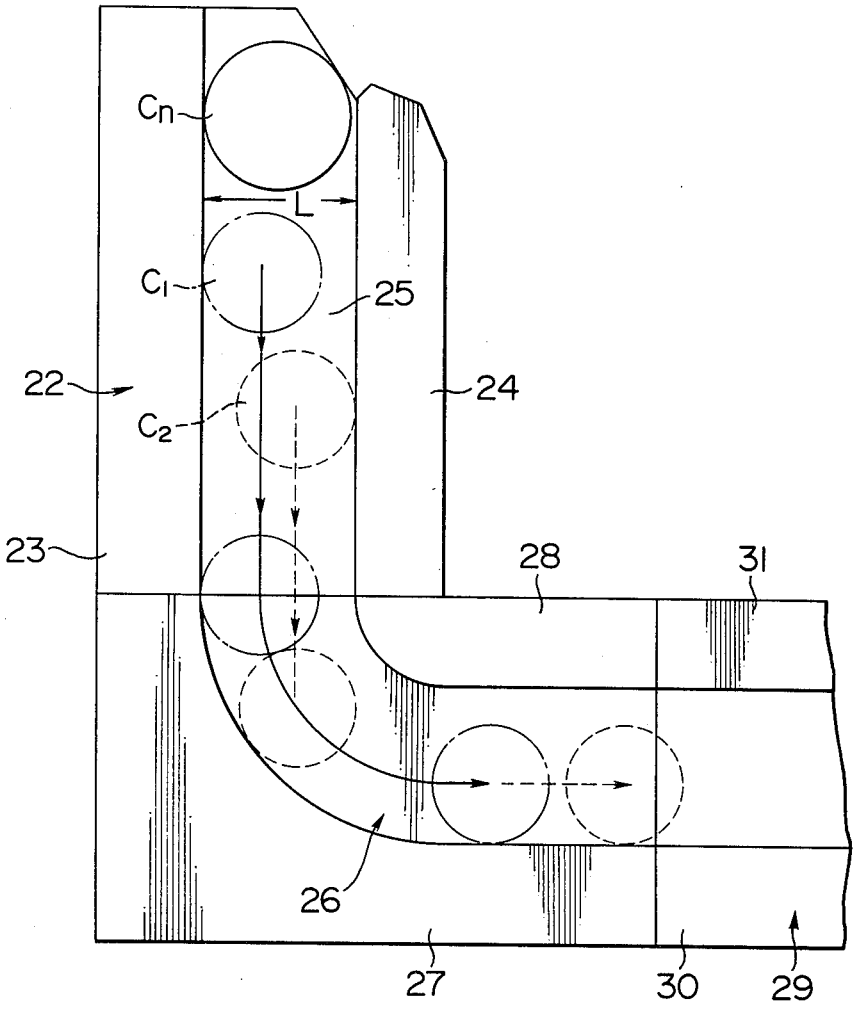

The operations of the coin selecting and counting machine thus constructed according to the present invention will be described in the following. When the mixed coins $C_1, C_2, ---, C_n$ poured from a hopper (not shown) onto the rotary disc 2, they are fed along the selecting ring 3 by the centrifugal force of the rotary disc 2 to the coin aligning course 4, in which they are brought into a ling so that they are discharged from the outlet 5. The mixed coins $C_1, C_2, ---, C_n$ thus discharged to the outlet 5 are unidirectionally conveyed on the bottom plate 25 of the guide rail section 22 by the action of the guide belt 37. Since, in this instance, the spacing L between the two guide rails 23 and 24 is made larger than the maximum diameter of the mixed coins $C_1, C_2, ---, C_n$, as better seen from FIG. 2, the mixed coins $C_1, C_2, ---, C_n$ being conveyed are not uniformly located. Whereever located, however, the mixed coins $C_1, C_2, ---, C_n$ have their circumferences forced into contact with the curved inner wall of the curved rail 27 so that they can be conveyed to the counting rail section 29 while being rotating in contact with the inner wall of the curved rail 27.

Since the outlet of the curved rail 27 is in line with the inlet of the reference rail 30 and since the counting belt 37 is inclined at the downstream end portion of the curved rail 27 with respect to the reference rail 30, the mixed coins $C_1, C_2, ---, C_n$ thus conveyed are subject to a component of force toward the reference rail 30 so that they are further conveyed while being forced into contact with the reference rail 30.

The mixed coins $C_1, C_2, ---, C_n$ thus conveyed to the counting rail section 29 then push their corresponding counting rollers $34_1, 34_2, ---, 34_n$ immediately upstream of their corresponding selecting holes $33_1, 33_2, ---, 33_n$ thereby to actuate their corresponding counting arms $36_1, 36_2, ---, 36_n$. As a result, the corresponding counters $35_1, 35_2, ---, 35_n$ are operated to generate their counting signals so that the numbers of the respective coins $C_1, C_2, ---, C_n$ are operated and indicated by means of corresponding circuits (not shown). After these counting operations, the mixed coins $C_1, C_2, ---, C_n$ are selectively allowed to fall down into their corresponding holes $33_1, 33_2, ---, 33_n$ so that they are reserved in their corresponding storage boxes (not shown).

As has been described hereinbefore, it should be appreciated as an advantage of the present invention that the accuracy for obtaining the reference position, which is important for the coin selecting process, can be remarkably improved by using a curved rail structure of simple construction. It should also be appreciated as another advantage of the present invention that the total length of the machine can be reduced together with its size because the disc turning mechanism and the counting rail section are overlapped in the longitudinal direction.

What is claimed is:

1. A coin selecting and counting machine for selecting and counting a number of mixed coins in accordance with the kinds thereof on the basis of the differences in their diameters, including a rotary disc made rotatable for discharging the mixed coins by the centrifugal force thereof, and a selecting and counting track extending downstream of said rotary disc and formed at its bottom with a number of selecting holes of sizes corresponding to the kinds of the mixed coins for receiving the discharged mixed coins to allow the same to fall into the corresponding selecting holes, while being unidirectionally conveyed one by one, so that they may be selected and conveyed, wherein the improvement comprises: said selecting and counting track including a guide rail section extending downstream of said rotary disc for guiding the discharged mixed coins, a curved rail section extending downstream of said guide rail section for changing the moving direction of the mixed coins to force the same into contact with the curved inner wall thereof, and a counting rail section extending downstream of said curved rail section; first conveying means for conveying the mixed coins from said guide rail section to said curved rail section; second conveying means for conveying the mixed coins from said curved rail section through said counting rail section, so that the mixed coins, which might otherwise be non-uniformly located widthwise of said selecting and counting track, have their circumferences forced into contact with the inner wall of said curved rail section and in accordance with the inner wall of said counting rail section; and counting means arranged in said counting rail section for counting each kind of the mixed coins;

wherein said curved rail section includes a curved rail having a large and a small radius of curvature and having an upstream end merged into the downstream end of said guide rail section so that the circumferences of the mixed coins are forced into contact with the inner wall of said curved rail having a larger radius of curvature;

wherein said counting rail section includes a reference rail and a selecting rail, both having their upstream ends merged into the downstream ends of said curved rail section so that the mixed coins are conveyed in contact with the inner wall of said reference rail.

2. A coin selecting and counting machine according to claim 1, wherein the first conveying means includes a guide belt made to run above said guide rail section and inclined outwardly in the downstream direction of the flow of the mixed coins so that the mixed coins are further forced into contact with the inner wall of said curved rail section.

3. A coin selecting and counting machine according to claim 1, wherein the second conveying means includes counting belts of the number corresponding to that of the mixed coins and made to run above said curved rail section and said counting rail section.

4. A coin selecting and counting machine according to claim 1, wherein said guide rail section includes a pair of guide rails extending in parallel at a spacing which is made slightly wider than the maximum diameter of the mixed coins so that the mixed coins may be introduced thereinto one by one.

5. A coin selecting and counting machine for selecting and counting a number of mixed coins in accordance with the kinds thereof on the basis of the differences in their diameters, including a rotary disc made rotatable for discharging the mixed coins by the centrifugal force thereof, and a selecting and counting track extending downstream of said rotary disc and formed at its bottom with a number of selecting holes of sizes corresponding to the kinds of the mixed coins for receiving the discharged mixed coins to allow the same to fall into the corresponding selecting holes, while being unidirectionally conveyed one by one, so that they may be selected and conveyed, wherein the improvement comprises: said selecting and counting track including a guide rail section extending downstream of said rotary disc for guiding the discharged mixed coins, a curved rail section extending downstream of said guide rail section for changing the moving direction of the mixed coins to force the same into contact with the curved inner wall thereof, and a counting rail section extending downstream of said curved rail section; first conveying means for conveying the mixed coins from said guide rail section to said curved rail section; second conveying means for conveying the mixed coins from said curved rail section through said counting rail section, so that the mixed coins, which might otherwise be non-uniformly located widthwise of said selecting and counting track, have their circumferences forced into contact with the inner wall of said curved rail section and in accordance with the inner wall of said counting rail section; and counting means arranged in said counting rail section for counting each kind of the mixed coins, wherein said counting means includes a series of counting rollers arranged in said counting rail section for the corresponding selecting holes and adapted to be actuated by the corresponding mixed coins, a series of corresponding counters arranged in said counting rail section and made operative to generate the counting signals of the corresponding mixed coins, and a series of corresponding rockable counting arms carrying the corresponding counting rollers and made rockable for operating the corresponding counters.

* * * * *